US005996817A

United States Patent [19]

Kao

[11] Patent Number: 5,996,817

[45] Date of Patent: Dec. 7, 1999

[54] TOOL SUSPENSION RACK ASSEMBLY

[76] Inventor: Jui-Chien Kao, No. 358, Tunghsing Rd., Shuwang Li, Tali City, Taichung Hsien, Taiwan

[21] Appl. No.: 09/012,996

[22] Filed: Jan. 26, 1998

[51] Int. Cl.[6] ..... A47F 7/00; A47B 96/06

[52] U.S. Cl. ..... 211/70.6; 248/220.31; 248/221.11

[58] Field of Search ..... 211/70.6; 206/207, 206/376, 378, 462, 467, 469; 248/220.31, 221.11

[56] References Cited

U.S. PATENT DOCUMENTS

| | | | |
|---|---|---|---|
| 2,841,289 | 7/1958 | Odlum et al. | 211/70.6 |
| 2,996,192 | 8/1961 | Dell et al. | 211/70.6 X |
| 4,372,468 | 2/1983 | Harvey | 211/70.6 X |
| 5,044,591 | 9/1991 | Huang | 211/70.6 X |
| 5,080,240 | 1/1992 | Williams | 211/70.6 |
| 5,713,467 | 2/1998 | Kao | 211/70.6 X |
| 5,762,211 | 6/1998 | Ensign | 211/70.6 |
| 5,816,401 | 10/1998 | Vasudeva et al. | 211/70.6 X |
| 5,862,913 | 1/1999 | Chou | 211/70.6 X |

*Primary Examiner*—David M. Purol
*Assistant Examiner*—Erica B. Harris
*Attorney, Agent, or Firm*—William E. Pelton, Esq.

[57] ABSTRACT

A suspension rack is a rack having a base plate defining at least one hole, at least one suspension plate defining a slot, and at least one fastener member including an abutting plate abutting a first side of the suspension plate. A lug extends from the abutting plate and is received in the slot. A snapping member having a stub extends from the lug and is received in the hole. An enlarged cone-shaped head extends from the stub and abuts a second side of the base plate.

1 Claim, 4 Drawing Sheets

TOOL SUSPENSION RACK ASSEMBLY

FIELD OF THE INVENTION

The present invention relates to a suspension rack assembly, and more particularly to a tool suspension rack assembly.

BACKGROUND OF THE INVENTION

A conventional tool suspension rack can be used in a retail outlet such as a hardware store for displaying a plurality of wrenches to be chosen by consumers. However, by such an arrangement, a person can steal the wrenches by freely detaching them from the wrench suspension rack.

Very often, anti-theft magnetic bar codes can only be printed on the wrench suspension rack, and cannot be printed on the wrenches whose surfaces are smooth, thus, sensors co-operating with the magnetic bar codes cannot detect the wrenches when they are detached from the wrench suspension rack. Therefore, the wrench suspension rack cannot deter theft.

The present invention has arisen to mitigate and/or obviate the disadvantage of the conventional tool suspension rack.

SUMMARY OF THE INVENTION

In accordance with one aspect of the present invention, there is provided a suspension rack assembly comprising a base plate including a first side and a second side, and at least one hole transversely defined through the base plate.

At least one suspension plate abuts on the base plate and includes a first side and a second side facing the second side of the base plate, and a slot is transversely defined in the suspension plate and communicates with the hole.

At least one fastener member is fixedly mounted on the suspension plate and includes an abutting plate abutting on the first side of the suspension plate, a lug extending from the abutting plate and received in the slot, and a snapping member including a stub extending from the lug and received in the hole, and an enlarged cone-shaped head extending from the stub and abutting on the second side of the base plate.

Further features of the present invention will become apparent after a careful reading of the detailed description with reference to the accompanying drawings.

DETAILED DESCRIPTION OF THE PREFERRED EMBODIMENTS

Figure 1:
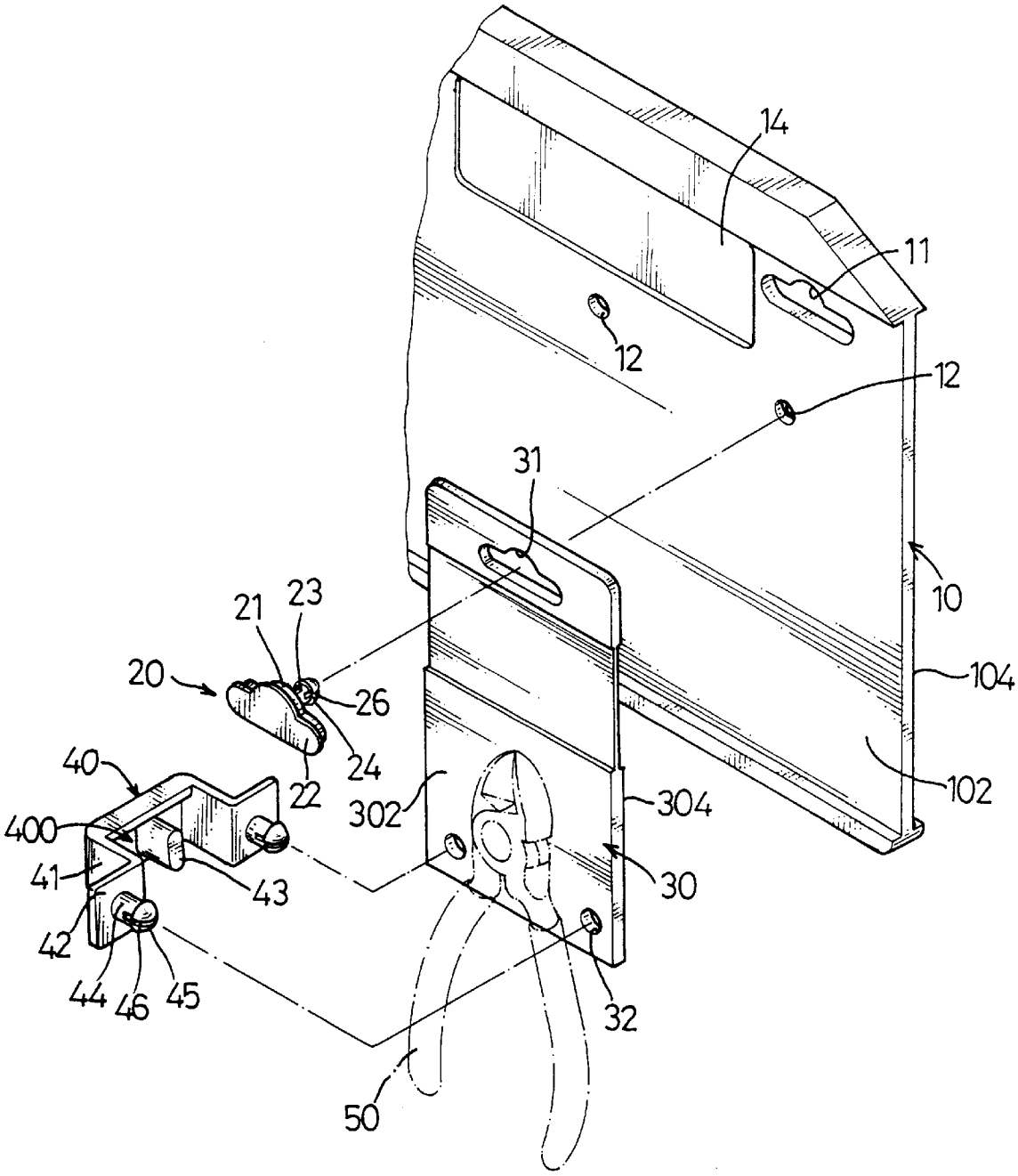
FIG. 1 is an exploded view of a tool suspension rack assembly in accordance with the present invention.

Referring to the drawings, a suspension rack assembly in accordance with the present invention can be adapted for attaching a plurality of tools such as a wrench, a pair of pliers or the like to a stable structure such as a vertical wall (not shown).

The suspension rack assembly comprises a base plate 10 vertically disposed and including a first side 102 and a second side 104, and a plurality of holes 12 transversely defined through the base plate 10.

The base plate 10 transversely defines two suspension slots 11 therein such that the base plate 10 can be attached to the vertical wall. An indicating zone 14 is formed on the first side 102 of the base plate 10 located between the two suspension slots 11 such that a mark, a pattern or the like can be printed on the indicating zone 14.

A plurality of suspension plates 30 each abut on the base plate 10 and each include a first side 302 and a second side 304 facing the second side 104 of the base plate 10, a slot 31 transversely defined in an upper portion of the suspension plate 30 and communicating with a corresponding one of the holes 12, and two bores 32 transversely defined in a lower portion of the suspension plate 30.

A plurality of fastener members 20 are each fixedly mounted on a corresponding one of the suspension plates 30 and each include an abutting plate 22 abutting on the first side 302 of the suspension plate 30, a lug 21 extending from the abutting plate 22 and received in the slot 31, and a first snapping member including a stub 23 extending from the lug 21 and received in a corresponding one of the holes 12, and an enlarged cone-shaped head 24 extending from the stub 23 and abutting on the second side 104 of the base plate 10.

Preferably, the lug 21 of the fastener member 20 has a shape mating that of the slot 31 of the suspension plate 30.

The enlarged cone-shaped head 24 of the first snapping member of each of the fastener members 20 transversely defines a slit 26 therein, thereby facilitating the enlarged cone-shaped head 24 to be inserted into the corresponding hole 12.

A plurality of U-shaped supporting brackets 40 are each mounted on a corresponding one of the suspension plates 30 and each comprise two side arms 41 each formed with an extension 42 abutting on the first side 302 of the suspension plate 30, a receiving space 400 defined in the supporting bracket 40 for receiving a tool 50, a catch 43 for supporting the tool 50, and two second snapping members each including a stub 44 extending from a corresponding one of the two extensions 42 and received in a corresponding one of the two bores 32, and an enlarged cone-shaped head 45 abutting on the second side 304 of the suspension plate 30 and defining a slit 46.

Figure 2:
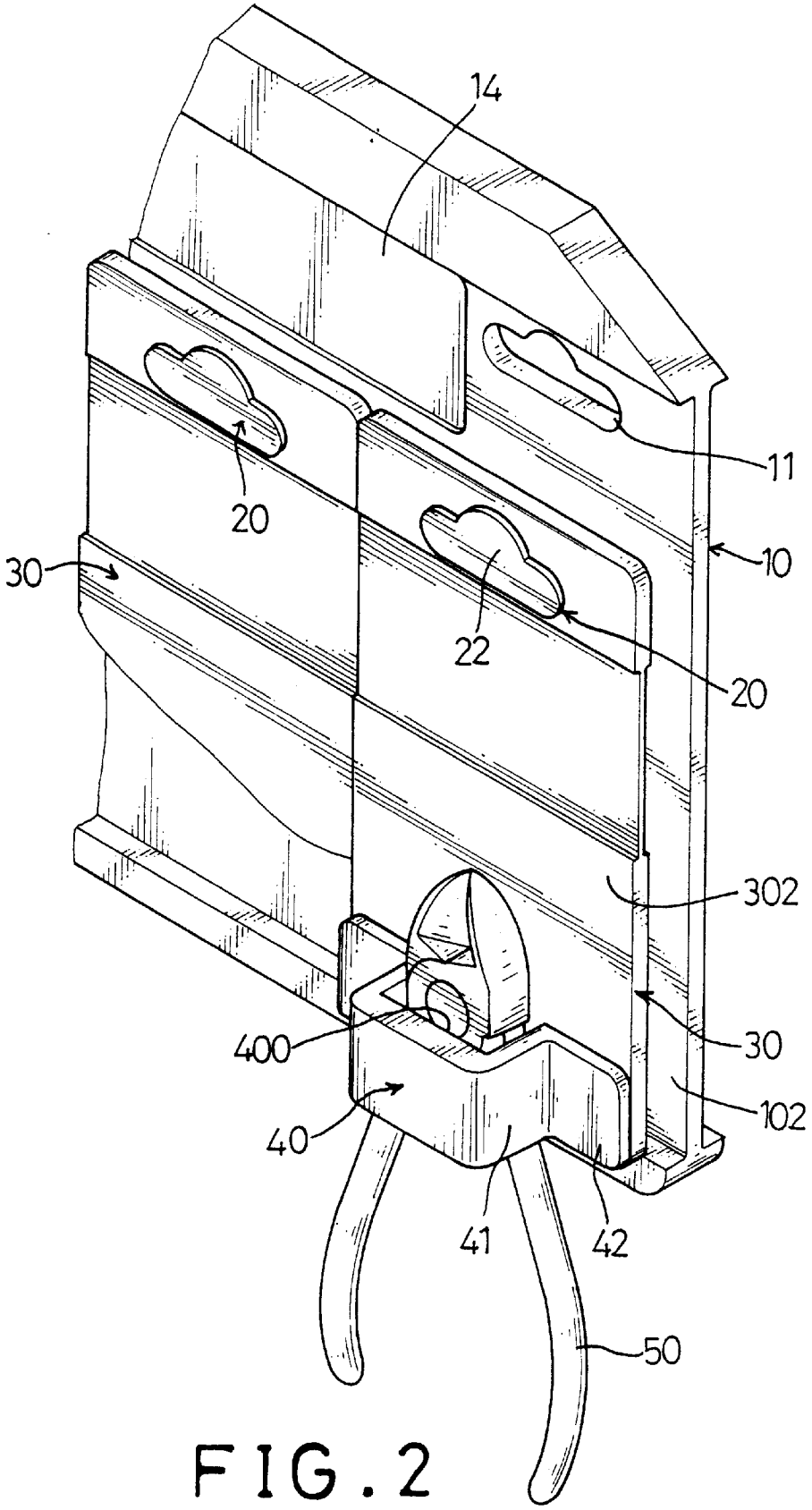
FIG. 2 is an assembly view of the tool suspension rack assembly shown in FIG. 1.
Figure 3:
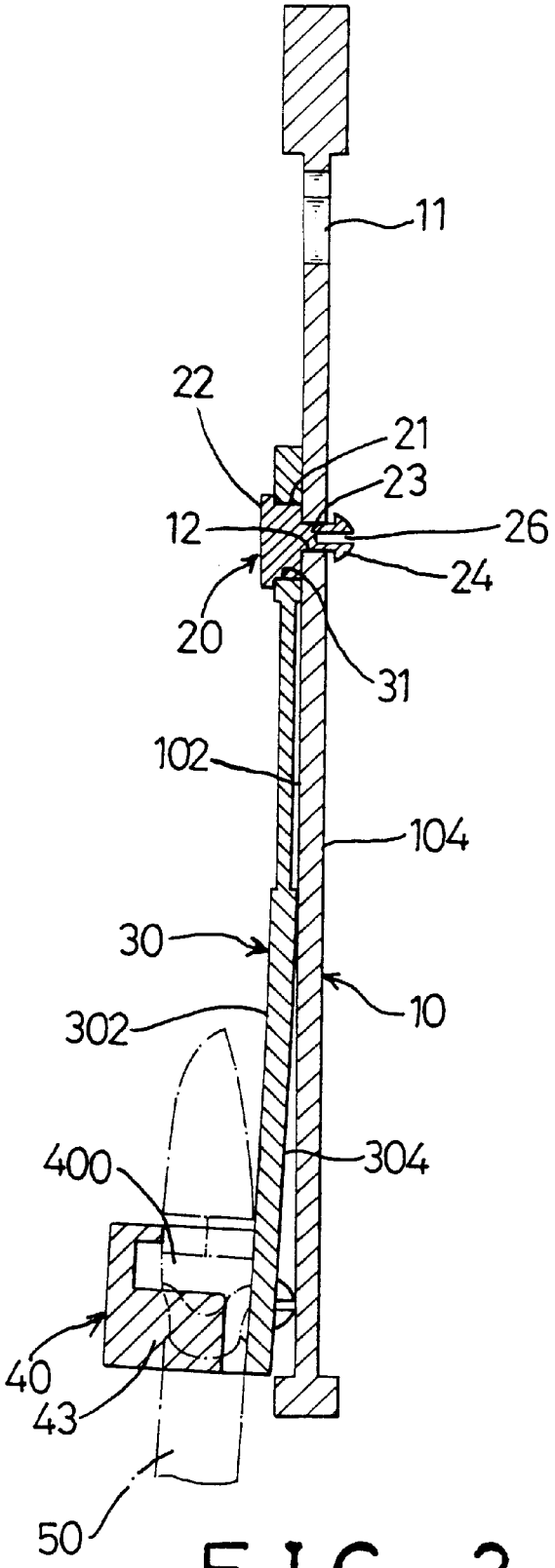
FIG. 3 is a side cross-sectional view of the tool suspension rack assembly shown in FIG. 2.

In operation, the tool 50 can be initially supported on the catch 43 of the supporting bracket 40 which can then be fitted onto the first side 302 of the suspension plate 30, with the enlarged cone-shaped head 45 of each of the two second snapping members being pressed to be inserted into the bore 32, thereby attaching the tool 50 to the suspension plate 30 as shown in FIG. 2.

The abutting plate 22 of the fastener member 20 can then be fitted onto the first side 302 of the suspension plate 30, with the lug 21 being inserted into the slot 31, and with the enlarged cone-shaped head 24 of the first snapping member being pressed to be inserted into the hole 12, thereby fixedly attaching the suspension plate 30 to the base plate 10 as shown in FIG. 2.

Figure 4:
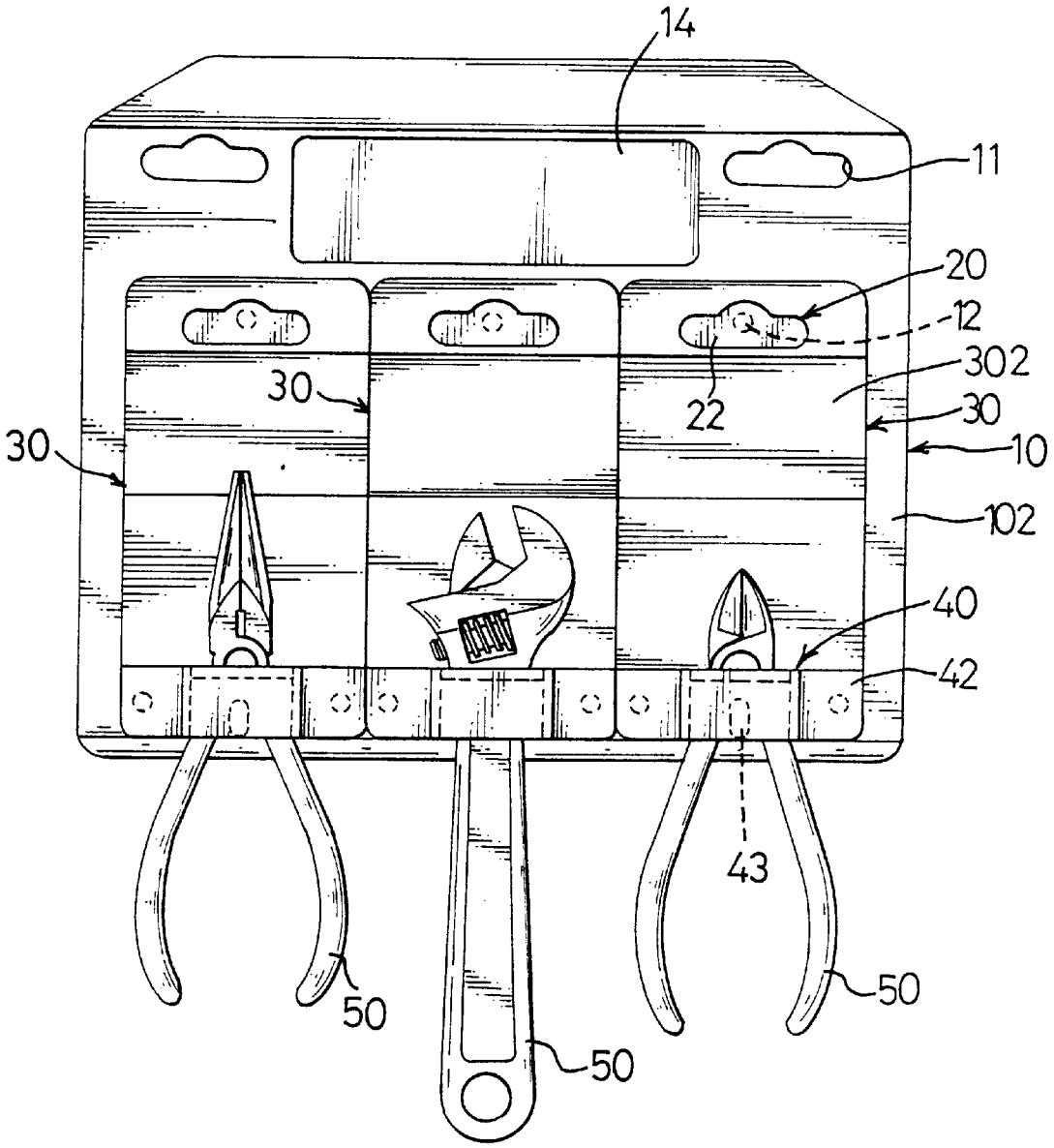
FIG. 4 is a front plan schematic view of the tool suspension rack assembly.

Referring to FIG. 4, a plurality of suspension plates 30 each can be securely mounted on the first side 102 of base plate 10, and a plurality of tools 50 each can be securely mounted on a corresponding one of the suspension plates 30.

By such an arrangement, each of the tools 50 cannot be detached from the respective suspension plate 30, and each of the suspension plates 30 cannot be detached from the base plate 10, thereby preventing someone from unauthorizedly taking the tool 50 from the associated suspension plate 30, and ultimately achieving an anti-theft purpose.

A consumer or employee of the retail outlet can use a tool such as a pair of scissors to cut off the enlarged head 24 of the first snapping member, thereby detaching the suspension plate 30 from the base plate 10, and to cut off the enlarged head 45 of each of the two second snapping members, thereby detaching the tool 50 from the suspension plate 30 for use.

It should be clear to those skilled in the art that further embodiments of the present invention may be made without departing from the scope and spirit of the present invention.

What is claimed is:

1. A suspension rack assembly comprising:

a base plate and a second side, and at least one hole transversely defined therethrough, said base plate transversely defining two suspension slots therein;

an indicating zone formed on said first side of said base plate;

at least one suspension plate detachably abutting said base plate and including a first side and a second side facing said second side of said base plate, and a slot transversely defined in said suspension plate and communicating with said hole; and at least one fastener member fixedly mounted on said suspension plate and including:

an abutting plate abutting said first side of said suspension plate;

a lug extending from said abutting plate and received in and flush with said slot, said lug having a shape mating that of said slot; and a snapping member including a stub extending from said lug and received in said hole, said stub having a dimension smaller than that of said lug, and an enlarged cone-shaped head extending from said stub and abutting said second side of said base plate, said enlarged cone-shaped head transversely defining a slit therein.

* * * * *